US009298206B2

(12) United States Patent
Klossek et al.

(10) Patent No.: US 9,298,206 B2
(45) Date of Patent: Mar. 29, 2016

(54) OPERATOR CONTROL ELEMENT WITH MAGNETIC RETURN

(75) Inventors: Arthur Klossek, Salz (DE); Thilo Schultheis, Bad Neustadt a. d. Saale (DE); Stefan Schuberth, Bad Neustadt a. d. Saale (DE)

(73) Assignee: PREH GMBH (DE)

( * ) Notice: Subject to any disclaimer, the term of this patent is extended or adjusted under 35 U.S.C. 154(b) by 0 days.

(21) Appl. No.: 14/353,464

(22) PCT Filed: Aug. 24, 2012

(86) PCT No.: PCT/EP2012/066521

§ 371 (c)(1),
(2), (4) Date: Apr. 22, 2014

(87) PCT Pub. No.: WO2013/060501

PCT Pub. Date: May 2, 2013

(65) Prior Publication Data

US 2014/0260771 A1 Sep. 18, 2014

(30) Foreign Application Priority Data

Oct. 25, 2011 (DE) ..... 10 2011 085 146

(51) Int. Cl.

| | |
|---|---|
| ***G05G 1/04*** | (2006.01) |
| ***G05G 5/05*** | (2006.01) |
| ***G05G 9/047*** | (2006.01) |

(52) U.S. Cl.

CPC .. *G05G 1/04* (2013.01); *G05G 5/05* (2013.01); *G05G 9/047* (2013.01); *Y10T 74/20612* (2015.01)

(58) Field of Classification Search

CPC ..... G05G 1/04; G05G 9/047
USPC ..... 335/205–207
See application file for complete search history.

(56) References Cited

U.S. PATENT DOCUMENTS

| | | | | |
|---|---|---|---|---|
| 6,755,195 | B1 * | 6/2004 | Lemke et al. | 128/849 |
| 2002/0093328 | A1 | 7/2002 | Maatta et al. | |
| 2006/0290670 | A1 | 12/2006 | Ishimaru | |

FOREIGN PATENT DOCUMENTS

| | | | |
|---|---|---|---|
| DE | 3922071 | A1 | 1/1991 |
| DE | 19954497 | C1 | 4/2001 |

(Continued)

OTHER PUBLICATIONS

International Search Report issued Dec. 20, 2012 re: PCT/EP2012/066521; citing: US 2002/093328 A1, DE 199 54 497 C1 and US 2006/290670 A1.

*Primary Examiner* — Ramon M Barrera
(74) *Attorney, Agent, or Firm* — Cantor Colburn LLP

(57) ABSTRACT

An operator control element with magnetic return for a number of switching and/or control functions: includes an abutment part; an actuating part which can be moved, for example displaced and/or pivoted, by hand from an inoperative position in at least two opposite directions with respect to the abutment part; magnetic return means for returning the actuating part into the inoperative position; and detection means for producing an electrical signal corresponding in each case at least to the maximum positions and the inoperative position of the actuating part. The magnetic return means include at least one actuating part-side ring magnets and one abutment part-side ring magnet arranged in the inoperative position such that the end faces thereof face one another and are spaced apart. They are arranged so as to pull the actuating part towards the abutment part and that they are concentric.

9 Claims, 4 Drawing Sheets

(56) References Cited

FOREIGN PATENT DOCUMENTS

| | | | |
|---|---|---|---|
| DE | 10031096 | A1 | 1/2002 |
| DE | 102008004909 | A1 | 7/2009 |
| EP | 1538517 | A2 | 6/2005 |
| EP | 2159455 | A1 | 3/2010 |

* cited by examiner

OPERATOR CONTROL ELEMENT WITH MAGNETIC RETURN

FIELD

The disclosure relates to an operating element for several regulating and/or switching functions. Generically, the operating element includes an actuating part that can be manually displaced and/or pivoted from a rest position into at least two opposite directions relative to an abutment part. Furthermore, magnetic returning means for causing the return of the actuating part into the rest position are provided. Depending on the capacity for moving into two, four or any directions up to maximum switching, the operating element according to the disclosure is a rocker switch, a four-way switch or a joystick. Detection means for generating an electrical signal that respectively corresponds to at least the maximum positions and the rest position of the actuating part are also provided according to the disclosure.

BACKGROUND

It is known to return operating elements in the range of movement of the actuating part into the rest position of the actuating part by means of components that are in mechanical engagement with one another. Moreover, several mechanically latching components for providing a haptic feedback are known. Such operating elements are subject to wear, so that the haptics and/or the relative positions change, or the function in its entirety is affected, as the wear increases. Furthermore, in order to reduce the susceptibility for wear, it is known to provide returning means that are based on magnetic forces. The designs known so far, such as the embodiments shown in DE 102008004909 A1, have a comparatively complex and voluminous design, because a mechanical operative engagement between the abutment part and the actuating part, for example in the form of an axle mounting or a ball joint, is mandatorily provided, among other things, in addition to the magnetic returning means. Such mechanical operative engagements are subject to wear, and thus, the positioning accuracy of the actuating part deteriorates.

In view of the drawbacks of the prior art, it is therefore an object of the present disclosure to further develop a generic operating element in such a way that it is especially low-wear, compact, and in particular improved with regard to its haptic feedback.

SUMMARY

The disclosure relates to an operating element for several switching and/or regulating functions comprising the following: an abutment part and an actuating part that can be manually displaced and/or pivoted from its rest position into at least two opposite directions relative to the abutment part. Magnetic returning means, i.e. returning means that are based upon magnetic forces, are provided for returning the actuating part into the rest position. They include, for example, one or more permanent magnets, ferromagnetic elements, electromagnets or combinations thereof. According to the disclosure, detection means for generating an electrical signal that respectively corresponds to at least the maximum positions and the rest position of the actuating part are provided. Preferably, the detection means are designed in such a way that an electrical signal uniquely corresponding, optionally proportionally, to all possible positions of the actuating part, is generated for the positional evaluation. The person skilled in the art knows detection means suitable for this purpose; for example, optical or resistive positional recognitions are provided.

According to the disclosure, the magnetic returning means include at least a first, actuating part-side annular magnet and a second, abutment part-side annular magnet, which in the rest position are disposed in such a way that their end faces face one another and are spaced from one another, that they are configured so as to pull the actuating part against the abutment part, and that they are concentrical. Not only does this embodiment cause a return that is free from wear, but a mutual retaining action is also obtained by the actuating part being pulled against the abutment part, in which an articulated mechanical connection between the two can be advantageously omitted.

According to a preferred embodiment, a securing device is furthermore provided, for example on the housing or on the abutment part, in order to secure the actuating part against loss. Because the mechanical attraction is used for retaining the actuating part, susceptibility for wear is minimized, or even ruled out. By using magnetic returning means, the haptic feedback during actuation of the actuating part can moreover be designed as required by appropriately dimensioning the annular magnets.

Preferably, the actuating part is disposed rotatably about an axis of rotation and the annular magnets are disposed concentrically with the axis of rotation. The rotatable mounting is realized, for example, by means of a sliding bearing arrangement between the abutment part and the actuating part. Due to the additional degree of freedom, an additional switching or regulating function during rotation of the actuating part can be assigned to the actuating part. The rotation and/or the rotary position are detected, for example, by means of optical, magnetic detection means.

According to a preferred embodiment, the first and second annular magnets are respectively polarized perpendicularly to the direction of movement.

According to another preferred embodiment, at least those end faces of the annular magnet that face one another are congruent. Preferably, the annular magnets have an identical size and configuration.

Preferably, the displacement distance of the actuating part-side annular magnet during the displacement or pivoting of the actuating part from the rest position into the maximum position corresponds to at least the wall thickness of the abutment part-side annular magnet. For example, the maximum position is selected in such a way that a crescent-shaped surface is formed if the facing end faces of the annular magnets are projected perpendicularly in their axial direction onto a common plane. This surface has, for example, a maximum distance of the crescent flanks of less than 1 mm, for example 0.5 mm.

It was found that, after an increase of the returning force in the case of increasing deflection of the actuating part, a haptically clearly perceptible drop in the returning force, also referred to as "snap", can thus be realized. Preferably, the actuating part is monostable, i.e. the returning force is never zero outside of the rest position. For example, one embodiment provides that, for generating a latching haptic action, the annular magnets are configured and disposed in such a way that the return force has a local maximum in the range of movement of the actuating part. Moreover, the sharp decrease of the returning force following the maximum after only a part, for example approximately half or two-thirds of the maximum possible deflection, leads to the maximum position inevitably being reached after overcoming the maximum return and the subsequent interruption. Thus, this increases operational reliability and at the same time provides the operator with a haptic feedback.

Preferably, the at least two opposite directions of movement define a line or a curve, still more preferably at least a circle segment.

According to a preferred embodiment, the abutment part includes one or more sliding or rolling elements for bearing the actuating part. In another embodiment, a cage for accommodating and guiding the rolling elements is provided.

In order to reduce wear, the detection means include means for the contact-free detection of the position of the actuating part or of the actuating part-side annular magnet. Still more preferably, this is at least one optical and/or magnetic sensor.

According to the disclosure, it can be provided that the annular magnets are provided exclusively for the return or the haptic feedback. Separate sensors and pick-ups with which the movement of the actuating part is detected can be provided for the position detection of the actuating part. An embodiment in which at least the actuating part-side annular magnet functions as a pick-up for one or more sensors, for example hall sensors, is to be comprised according to the disclosure.

The operating element advantageously is used in a motor vehicle, for example as an operating element for controlling the vehicle air conditioning.

BRIEF DESCRIPTION OF THE FIGURES

The disclosure as well as the technical environment is explained in more detail below with reference to the figures. It must be remarked that the Figures depict a particularly preferred embodiment of the disclosure, but that it is not limited thereto. The Figures schematically show.

DETAILED DESCRIPTION OF THE FIGURES

Figure 1:
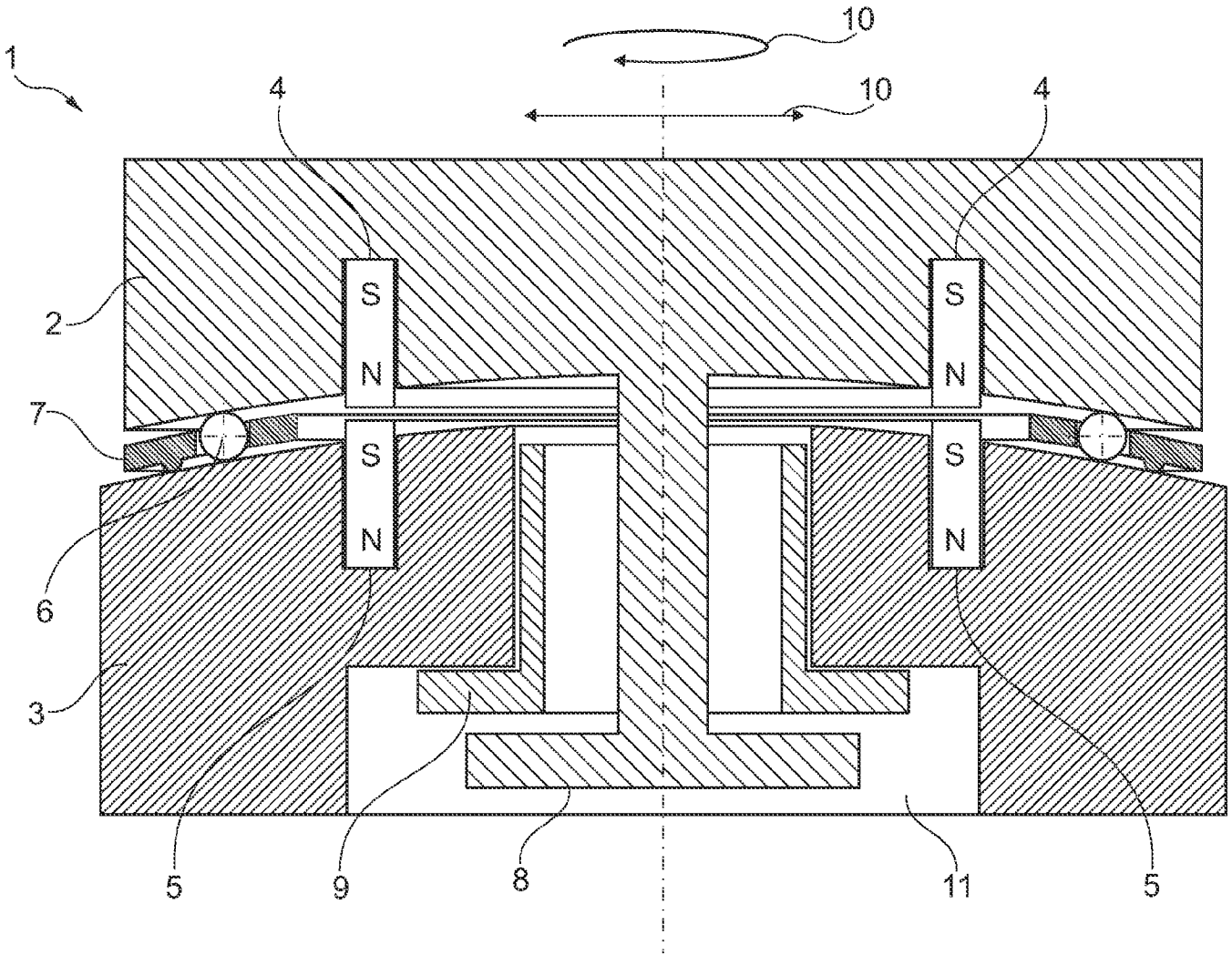
FIG. 1: the rest position of the actuating part 2 of the operating element 1 according to the disclosure, which is shown in a preferred embodiment.

In a simplified schematic representation, the Figures show the structure as well as the mode of operation of the operating element 1 according to the disclosure. The operating element 1 includes an abutment part 3 and an actuating part 2. The abutment part 3 includes a convex surface facing towards the actuating part 2. The actuating part 2 includes a concave surface formed complementarily to said surface of the abutment part 3 and facing the abutment part 3. The actuating part 2 is freely displaceable or pivotable relative to the abutment part 3. The respective position can be detected by a detection device which is not shown. The abutment part 3 includes a rolling bearing device in order to facilitate the displacement of the actuating part 2 and to minimize the wear. The rolling bearing device includes several annularly disposed balls 6 that are guided evenly spaced by means of a cage 7. In addition to the displaceability, a rotation of the actuating part 2 is made possible; in this regard, see the motion-indicating arrows 10, wherein the displacement is made possible in all directions, also in a direction perpendicular to the drawing plane, and is to be described in the following, limited to the directions according to the arrows 10 only for the purpose of a better illustration of the movements.

Figure 2:
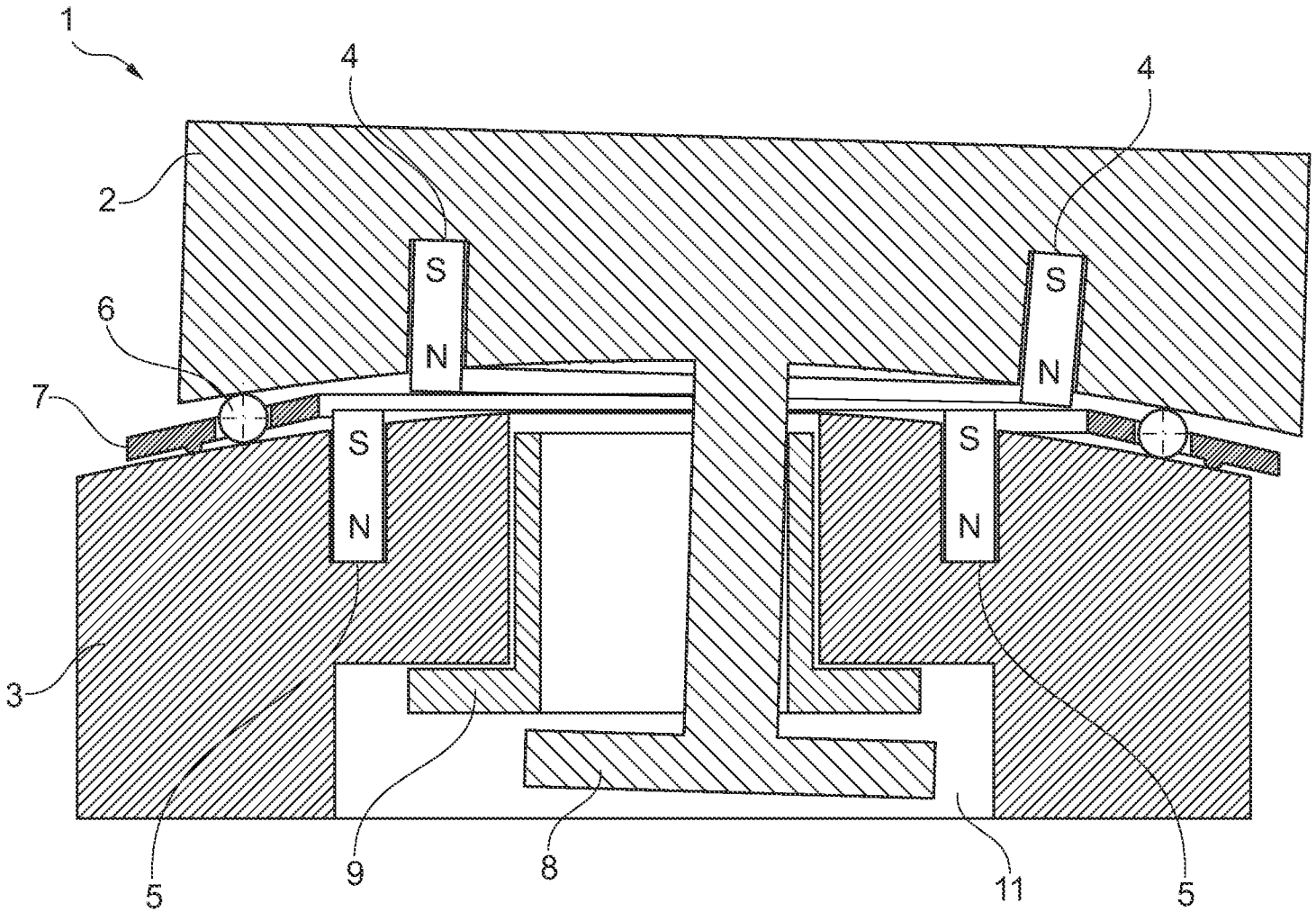
FIG. 2: the maximum position of the actuating part 2 of the operating element 1 from FIG. 1.
Figure 3A:
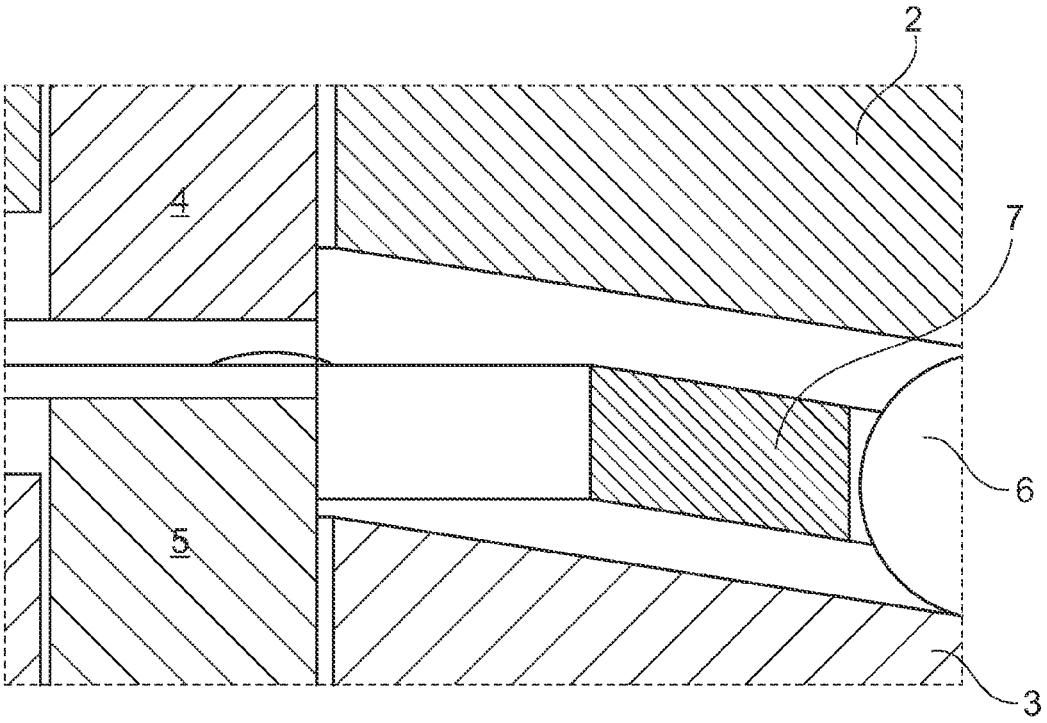
FIG. 3A: an enlarged detailed view of FIG. 1.
Figure 3B:
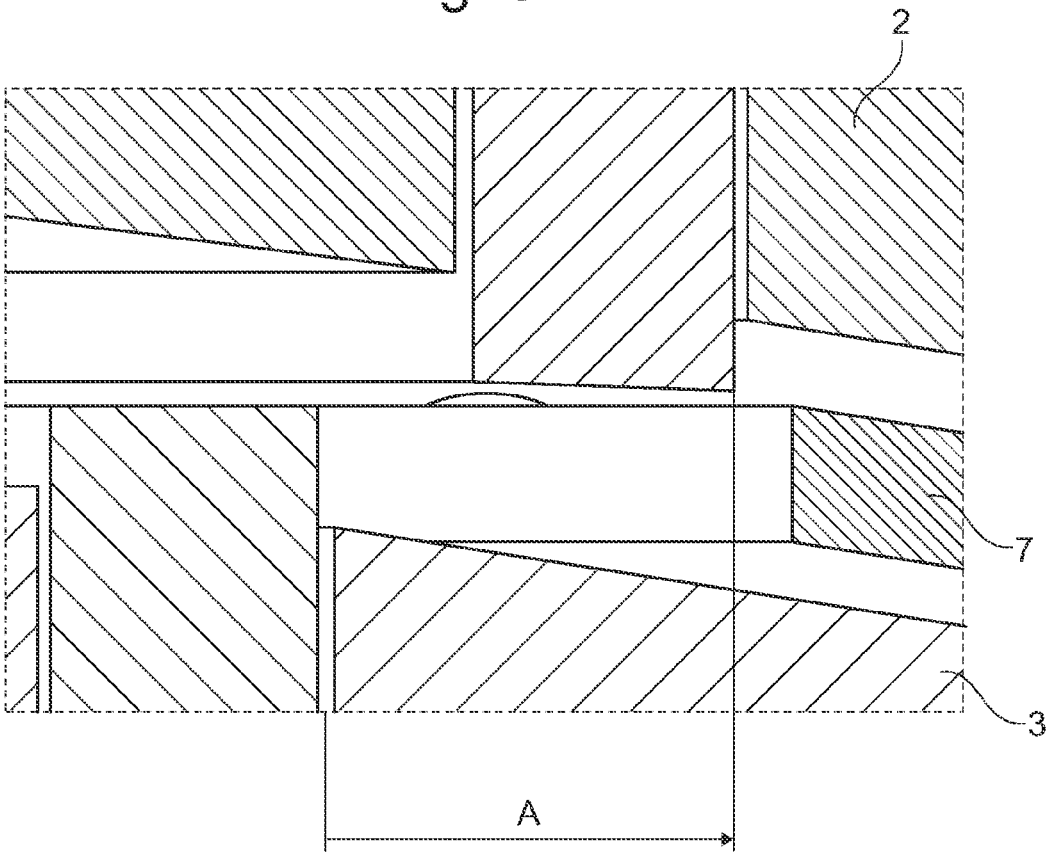
FIG. 3B: an enlarged detailed view of FIG. 2.
Figure 4:
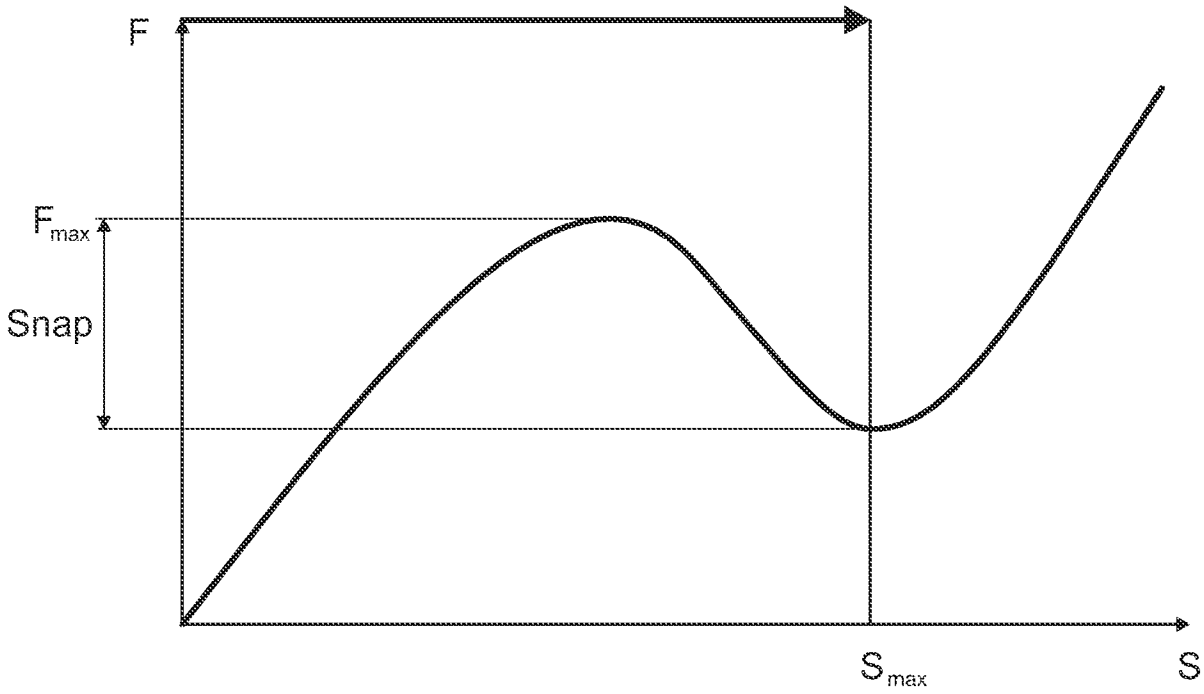
FIG. 4: a profile of the returning force F to be overcome by the operator as a function of the deflection distance S traveled from the rest position.

The movement of the actuating part 2 is limited by the pin 8 guided through a through-bore 11 in the abutment part, the pin 8, as securing device, moreover being secured against falling out by its plate-shaped, for example screwed-on, expanded portion at the end thereof, and the sleeve 9. A separation of the actuating part 2 and the abutment part 3 is thus made largely impossible. Annular grooves, into which an annular permanent magnet 4, 5, hereinafter referred to as an annular magnet, is respectively inserted, are respectively incorporated into the facing surfaces of the actuating part 2 and the abutment part 3. The annular magnets 4, 5 have the same dimensions and are polarized parallel to their axial direction, i.e. their axis of rotational symmetry. The annular magnets 4, 5 are disposed in such a way that unlike poles and the end faces are spaced apart and opposite from one another in the rest position shown in FIG. 1. Moreover, the annular magnets 4, 5 are disposed concentrically with the axis of rotation of the actuating part 2 in the rest position. The maximum position shown in FIG. 2 is reached during the displacement of the actuating part 2 from the rest position shown in FIG. 1 in a direction lying in the drawing plane. The annular magnets 4, 5 cause the return into the rest position shown in FIG. 1. During the pivoting process, the actuating part-side annular magnet 4, with the annular sections thereof that are located at the front and rear in the direction of movement, moves away from the respective annular sections of the abutment part-side annular magnet 5. The maximum position is selected in such a way that the actuating part-side annular magnet 4 is displaced by more than the thickness of the wall of the abutment part-side annular magnet 5. Preferably, the offset of the annular magnets 4, 5, i.e. the projected distance between the internal diameter of the actuating part-side annular magnet 4 and the external diameter of the abutment part-side annular magnet 5 in the maximum position and in the respective displacement direction is between approximately or exactly 1.0 mm and approximately or exactly 5.0 mm. The relative movement of the annular magnets 4, 5 is illustrated in the detailed views of the FIGS. 3A and 3B. FIG. 4 shows the profile of the returning force as a function of the deflection distance. It increases sharply during the displacement of the actuating part from the rest position to reaching the local maximum $F_{max}$. Once the actuating part-side annular magnet is displaced by the wall thickness of the abutment part-side annular magnet, the returning force sharply decreases without completely returning to zero. After that, the maximum position is reached at $S_{max}$ due to abutment against a stop. The sharp decrease of the returning force described above, which is also referred to as "snap", can be perceived haptically and serves for providing the operator with a haptic feedback on the fact that the maximum position has been reached. The increase of the returning force with the subsequent sharp decrease moreover provides for the maximum position to be reached reliably and almost inevitably, provided the maximum returning force $F_{max}$ was overcome once. This increases reproducibility and reliability in operation.

The invention claimed is:

1. Operating element for several switching and/or regulating functions comprising:

an abutment part;

an actuating part that can be manually moved from a rest position into at least two opposite directions relative to the abutment part; magnetic returning means for causing the return of the actuating part into the rest position;

wherein the magnetic returning means includes at least a first, actuating part-side annular magnet and a second, abutment part-side annular magnet, which in the rest position are disposed in such a way that their end faces face one another and are spaced from one another, that they are configured so as to pull the actuating part against the abutment part, and that they are concentrical, wherein at least the end faces of the first and second annular magnets that face one another are congruent, wherein a displacement distance of the actuating part-side annular magnet in the respective direction of movement during a displacement or a pivoting of the actuating part from the rest position into the maximum position corresponds to at least the wall thickness of the abutment part-side annular magnet.

2. Operating element according to claim 1, wherein the actuating part is disposed rotatably about an axis of rotation and the first and second annular magnets are disposed concentrically with the axis of rotation.

3. Operating element according to claim 1, wherein the first and second annular magnets are respectively polarized perpendicularly to the direction of movement.

4. Operating element according to claim 1, wherein the at least two opposite directions of movement define a line or a curve.

5. Operating element according to claim 1, wherein the actuating part is freely pivotable or freely displaceable relative to the abutment part.

6. Operating element according to claim 1, wherein the abutment part includes one or more sliding or rolling elements for bearing the actuating part.

7. Use of the operating element according to claim 1 in a motor vehicle.

8. Operating element according to claim 1, wherein the at least two opposite directions of movement define a circle segment.

9. Operating element for several switching and/or regulating functions comprising: an abutment part;

an actuating part that can be manually moved from a rest position into at least two opposite directions relative to the abutment part; magnetic returning means for causing the return of the actuating part into the rest position;

wherein the magnetic returning means includes at least a first, actuating part-side annular magnet and a second, abutment part-side annular magnet, which in the rest position are disposed in such a way that their end faces face one another and are spaced from one another, that they are configured so as to pull the actuating part against the abutment part, and that they are concentrical, wherein at least the end faces of the first and second annular magnets that face one another are congruent and projected perpendicularly, wherein a displacement distance of the actuating part-side annular magnet in the respective direction of movement during a displacement or a pivoting of the actuating part from the rest position into the maximum position corresponds to at least the wall thickness of the abutment part-side annular magnet such that a crescent-shaped surface is formed.

* * * * *